US007537110B2

(12) United States Patent
Kutsch et al.

(10) Patent No.: US 7,537,110 B2
(45) Date of Patent: May 26, 2009

(54) CONTAINER FOR CONSUMER ARTICLE

(75) Inventors: John H. Kutsch, Crystal Lake, IL (US); Rutger Thiellier, Chicago, IL (US); Andrew Vest, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 391 days.

(21) Appl. No.: 11/142,420

(22) Filed: Jun. 2, 2005

(65) Prior Publication Data

US 2006/0283721 A1 Dec. 21, 2006

(51) Int. Cl.
*A45C 15/00* (2006.01)
*A45C 11/18* (2006.01)

(52) U.S. Cl. ..... 206/39; 206/39.3; 206/39.5; 206/38

(58) Field of Classification Search ..... 206/37, 206/38, 39, 39.3, 39.5, 267, 270, 236; 220/345.1, 220/345.2, 345.3, 839, 811, 812, 813; D9/426
See application file for complete search history.

(56) References Cited

U.S. PATENT DOCUMENTS 1,163,773 A * 12/1915 Ross ..... 206/1.5
2,037,912 A * 4/1936 Lisner ..... 206/263
2,050,079 A * 8/1936 Zell ..... 206/250
2,076,353 A * 4/1937 Samstag ..... 220/4.22
2,099,122 A * 11/1937 Kreisler ..... 132/303
3,325,000 A * 6/1967 Edwards ..... 206/256
4,076,117 A 2/1978 Wisdom et al.
4,113,098 A 9/1978 Howard
4,126,224 A 11/1978 Laauwe et al.
4,174,034 A 11/1979 Hoo
4,364,488 A 12/1982 Anjou
4,485,915 A 12/1984 Berghahn
4,561,544 A 12/1985 Reeve
4,844,284 A 7/1989 Drozd et al.
4,932,547 A * 6/1990 Rodriguez ..... 220/8
5,080,222 A 1/1992 McNary
5,082,137 A 1/1992 Weinstein (Continued)

FOREIGN PATENT DOCUMENTS

CH 529013 A 10/1972

(Continued)

OTHER PUBLICATIONS

International Search Report and Written Opinion dated Feb. 9, 2007 for PCT/IB2006/002909.

(Continued)

*Primary Examiner*—J. Gregory Pickett
(74) *Attorney, Agent, or Firm*—Buchanan Ingersoll & Rooney PC

(57) ABSTRACT

A pocket-sized container for consumer products includes a tray which may be sealed with a two-part seal. One container section formed as a clam shell closes over a portion of the tray. Another container section also formed as a clam shell closes over the remaining portion of the tray. The tray includes an end surface to facilitate removal of the container contents. Guide assemblies align the two container section during movement between an open and a closed position. A detent arrangement releasably holds the two sections in the closed position.

15 Claims, 12 Drawing Sheets

U.S. PATENT DOCUMENTS

| | | | | |
|---|---|---|---|---|
| 5,275,291 | A | 1/1994 | Sledge | |
| D352,895 | S | 11/1994 | van Loo | |
| D384,538 | S * | 10/1997 | Bosworth | D6/632 |
| D406,487 | S * | 3/1999 | Attar et al. | D6/632 |
| D407,972 | S | 4/1999 | Hilton | |
| 6,199,695 | B1 * | 3/2001 | Takeo | 206/380 |
| D446,718 | S | 8/2001 | Anderson | |
| D451,799 | S | 12/2001 | Berger et al. | |
| 6,341,693 | B2 | 1/2002 | Konno et al. | |
| 6,341,710 | B1 | 1/2002 | Danielson et al. | |
| D460,352 | S | 7/2002 | Bried | |
| D465,729 | S | 11/2002 | Nishimura | |
| D494,466 | S | 8/2004 | Devine | |
| D497,246 | S | 10/2004 | Darst | |
| D497,803 | S | 11/2004 | Nichols et al. | |
| 7,124,883 | B1 * | 10/2006 | Thomas et al. | 206/256 |
| 2004/0173613 | A1 | 9/2004 | Schroeder et al. | |

FOREIGN PATENT DOCUMENTS

| | | | |
|---|---|---|---|
| DE | 2544743 | A1 | 4/1977 |
| GB | 2174075 | A | 10/1986 |
| NL | 6401066 | A | 8/1965 |
| WO | 03/094823 | A | 11/2003 |

OTHER PUBLICATIONS

Partial International Search Report dated May 3, 2007 for PCT/IB2006/003333.

* cited by examiner

CONTAINER FOR CONSUMER ARTICLE

FIELD OF THE INVENTION

This disclosure generally concerns a container for one or more consumer articles. More particularly, this disclosure relates to a pocket-sized container having a slidable portion that opens to reveal a sealed drawer containing a plurality of articles.

SUMMARY

A container according to this disclosure includes an internal tray surrounded by a first section and a second section. The internal tray may be an integral part of the first section. The first section includes top and bottom panels, two side panels, an end panel and a closable end. To form the first section, the top and bottom panels are brought into overlying relationship by flexing an integral hinge in the end panel.

The second section also includes top and bottom panels, two side panels, an end panel and a closable end. A portion of the tray extending from the first section is slidably received in the second section. By flexing an integral hinge in the end panel of the second section, the top and bottom panels of the second section are brought into overlying relationship. Suitable guide slots and detents between the second section and the extending tray portion permit the second section to slide on the extending tray portion between a fully open position and fully closed position where the openable end of the second section abuts the openable end of the first section.

To secure the top and bottom panels of the first section in their overlying relationship, a pair of cheek members is attached to corresponding sides thereof. Similarly, to secure the top and bottom panels of the second section in their overlying relationship, a second pair of cheek members is attached to corresponding sides of the second section.

The container also includes features to facilitate single-handed operation. More particularly, the cheek members of the first and second sections are recessed at the location of the abutting openable ends. Those recesses provide a convenient shoulder that may be grasped by one or two fingers of a hand. Moreover, a thumb depression and raised abutment are provided in the top panels at the location of the abutting openable ends. Preferably, the depression is shared between the top panels of the first and second section. The abutment preferably is contiguous with the portion of the depression in the first section so that a thumb can press against the abutment, while the fingers hold the side shoulders of the second section, to slide the first section away from the second section and at least partially expose the extending portion of the tray.

Where the articles in the tray are subject to freshness considerations, the tray can be sealed. For example, a planar seal can be attached to a lip surrounding the tray when the contents have been dispensed into the tray. Preferably, the planar seal has a precut window that registers with the exposed portion of the tray. To seal that precut window, a tear-off seal is preferably provided that covers the window and includes a pull tab to facilitate its removal.

BRIEF DESCRIPTION OF THE DRAWINGS

This disclosure is best understood when this written description is read in conjunction with the drawings wherein like reference numerals have been applied to like elements and wherein.

DETAILED DESCRIPTION OF THE PREFERRED EMBODIMENTS

Figure 1:
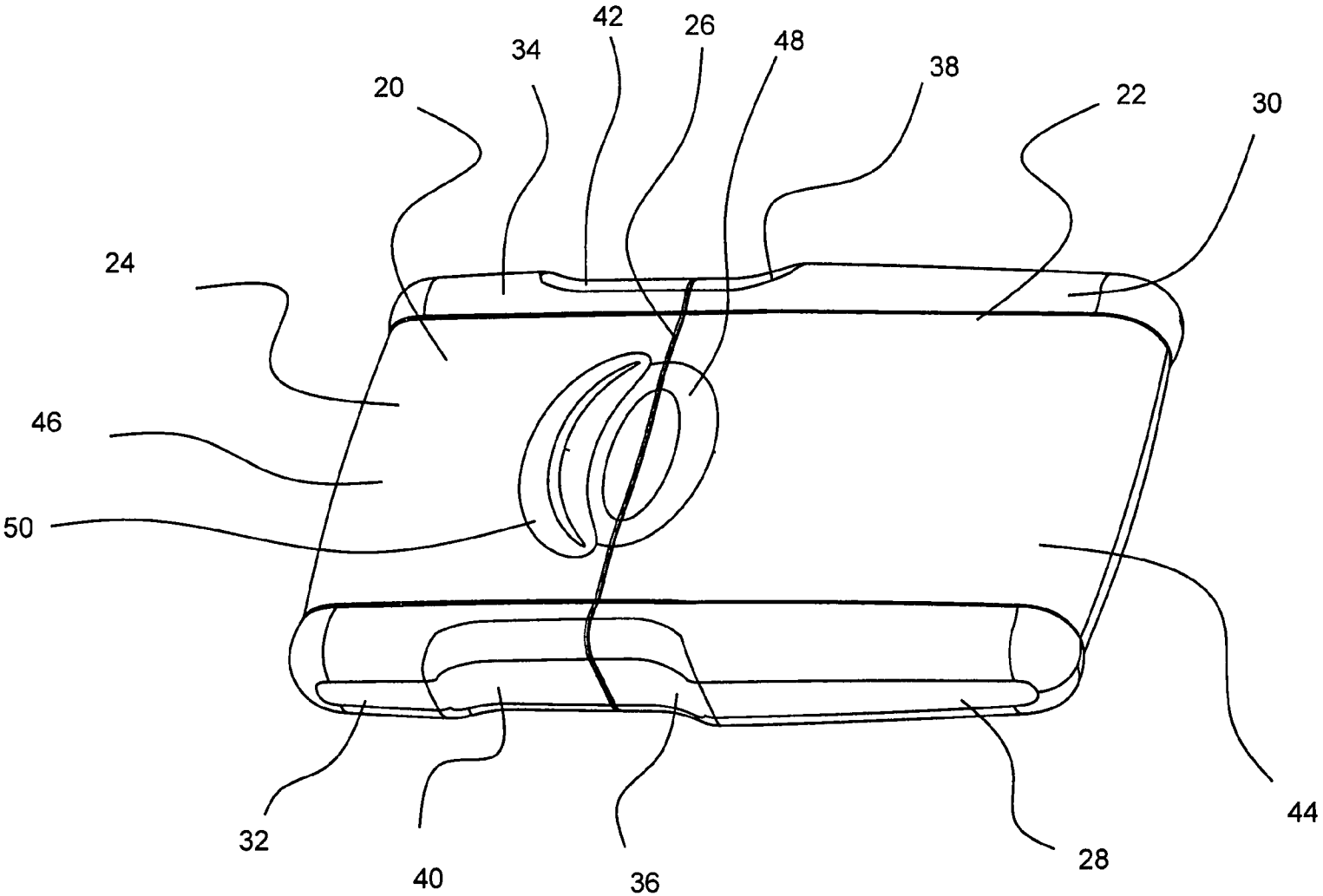
FIG. 1 is a perspective view of the container according to this disclosure in a closed position.

In accordance with this disclosure, a container 20 (see FIG. 1) for consumer products, includes a first section 22 and a second section 24. A parting line 26 is located between the first section 22 and the second section 24 and defines the location where the first section 22 and the second section 24 abut one another in a first closed position and can be moved relative to one another to a second open position to expose the contents of the container 20.

A first pair of cheek members 28, 30 is provided for the first section 22, one cheek member being positioned on each side of the section 22. A second pair of cheek member 32, 34 is provided for the second section 24, one cheek member being positions on each side of the section 24. The two pair of cheek members 28, 30, 32, 34 preferably are fabricated from a material that is relatively soft to the touch. Elastomeric materials are particularly suitable for the cheek members. For example, 95 durometer polypropylene comprises a suitable material, although other conventional materials with comparable properties may also be advantageously used. The cheek members preferably snap into position on the container 20 and provide generally smooth, rounded sides for the container. The cheek members 32, 34 of the second section 24 are shorter than the cheek members 28, 30 of the first section. The length of those cheek members is selected to extend from the parting line 26 to the associated end panel of the corresponding section so that the entire side of the container has elastomeric material thereon.

Figure 4:
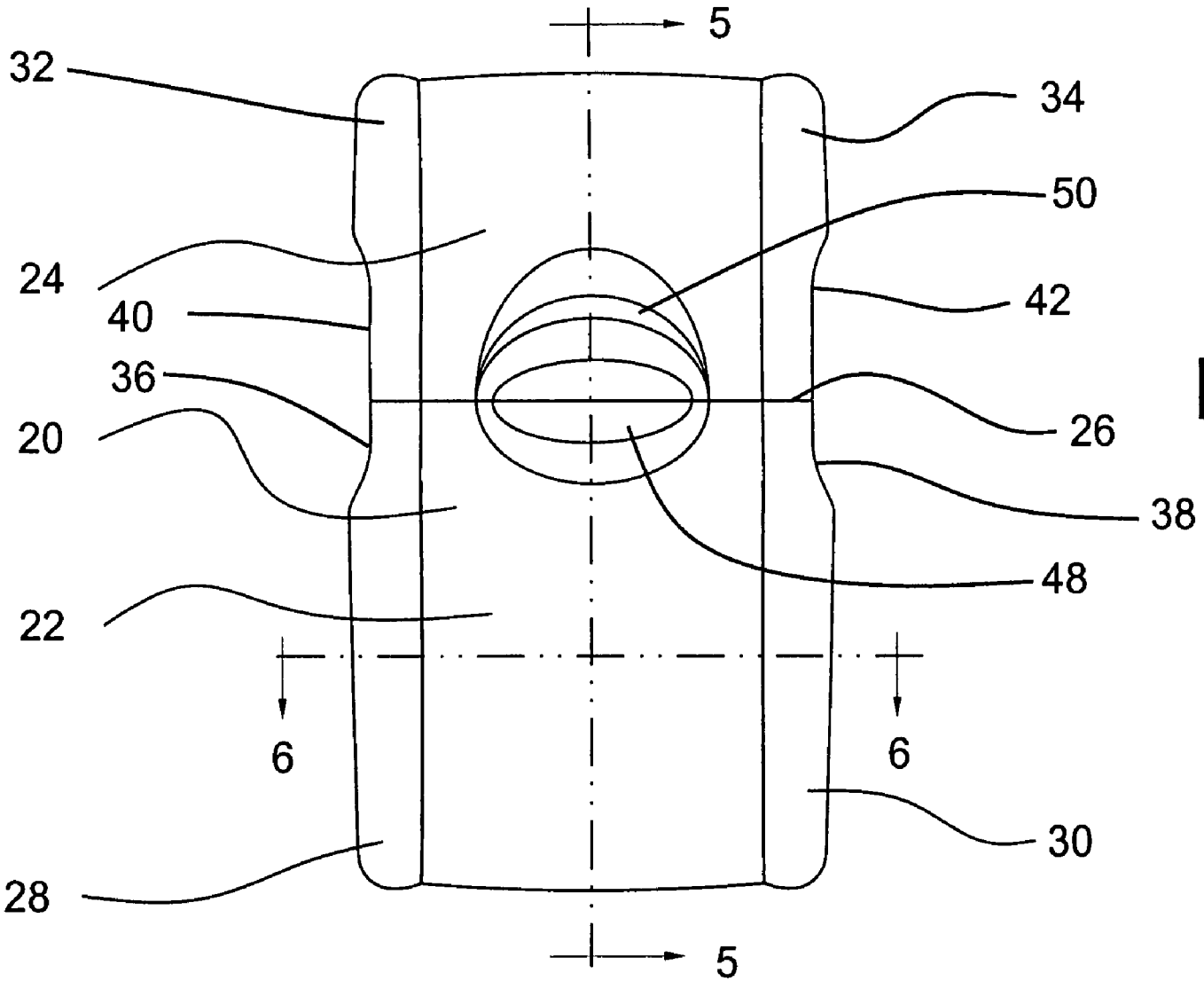
FIG. 4 is a top view of the container.

As seen in FIG. 4, each cheek member 28, 30, 32, 34 has a corresponding recess 36, 38, 40, 42 adjacent to the parting line 26. These recesses are sized to accommodate the fingers of the container user. For example, the recesses 36, 28 of the first pair of cheek members 28, 30 are sized to accommodate the first and second fingers of the container user's hand. In this way, the container 20 can conveniently be held in one hand during use. The recesses 40, 42 of the second pair of cheek member 32, 34 are sized to conveniently accommodate the thumb of the container user's hand. Thus, the user can use the thumb of the hand holding the container to separate the first and second sections 22, 24. Alternatively, the user can hold the first section 22 of the container 20 in one hand and use the thumb and forefinger of the other hand to separate the first and second sections 22, 24.

A top panel 44 of the first section 22 and a top panel 46 of the second section 24 preferably include a finger abutment arrangement that may also be used to separate the first and section sections 22, 24. The finger abutment arrangement may include a depression 48 which straddles the parting line 26. In addition, the finger abutment arrangement may further include a crescent-shaped ridge 50 which protrudes above the top panel 46 of the second section 24. A substantially continuous surface may extend from the bottom of the depression 48 to the top of the ridge 50 to present a surface against which the user can press the thumb of the hand holding the container 20.

Figure 2:
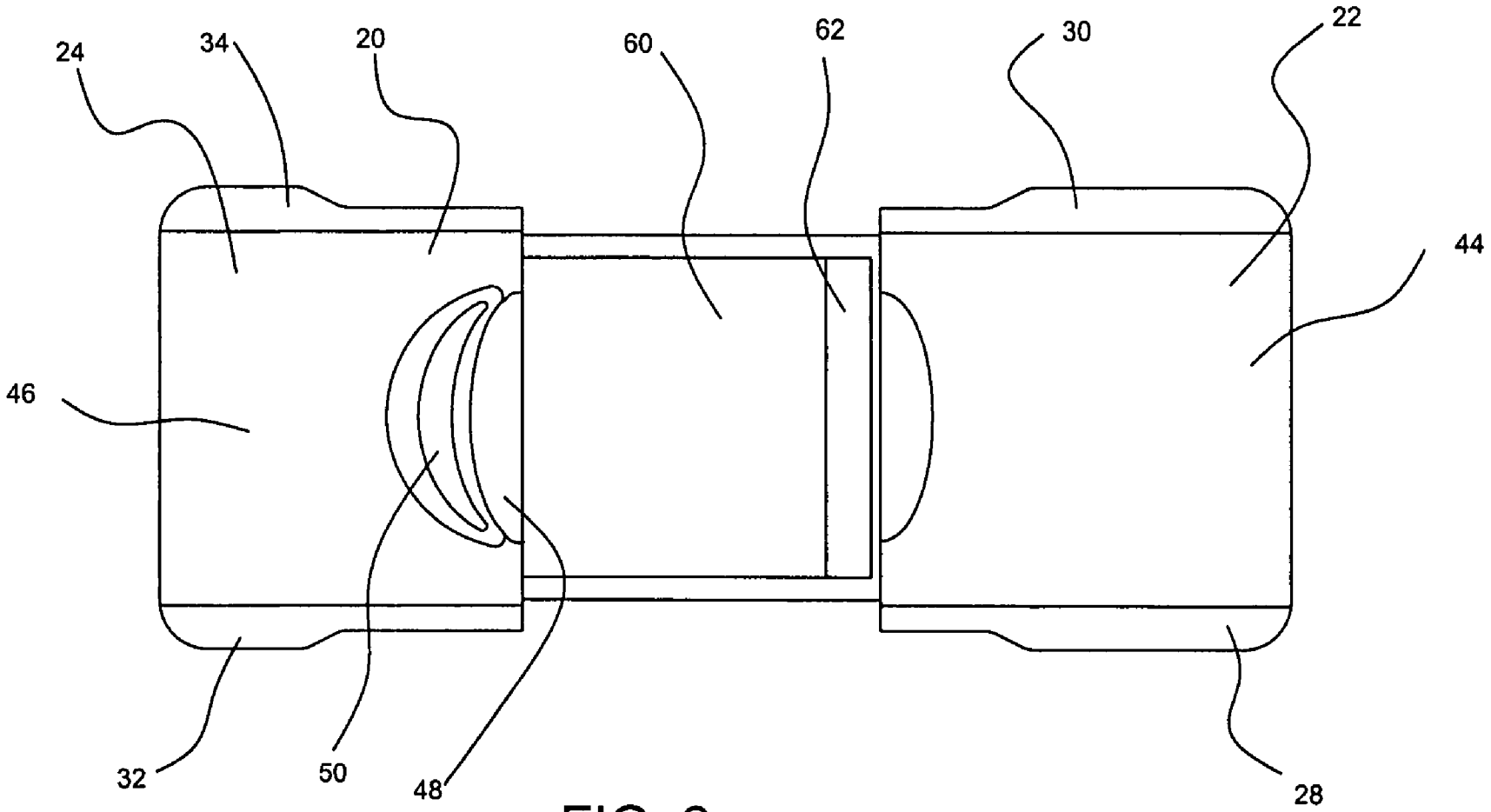
FIG. 2 is a perspective view of the container in an open position.

When the first and second sections 22, 24 are separated (see FIG. 2), a portion of a tray 60 extends between the two sections 22, 24. The tray 60 preferably includes a sloped end wall 62 at the end received by the second section 24. That sloped end wall 62 facilitates removal of articles packaged in the container 20 by making it easy to slide individual articles up the sloped end wall 62 and out of the tray 60. The tray 60 preferably is integrally formed with the second section 24 (see FIG. 5). Moreover, the end wall 62 may be curved convexly upward, as shown.

Figure 3:
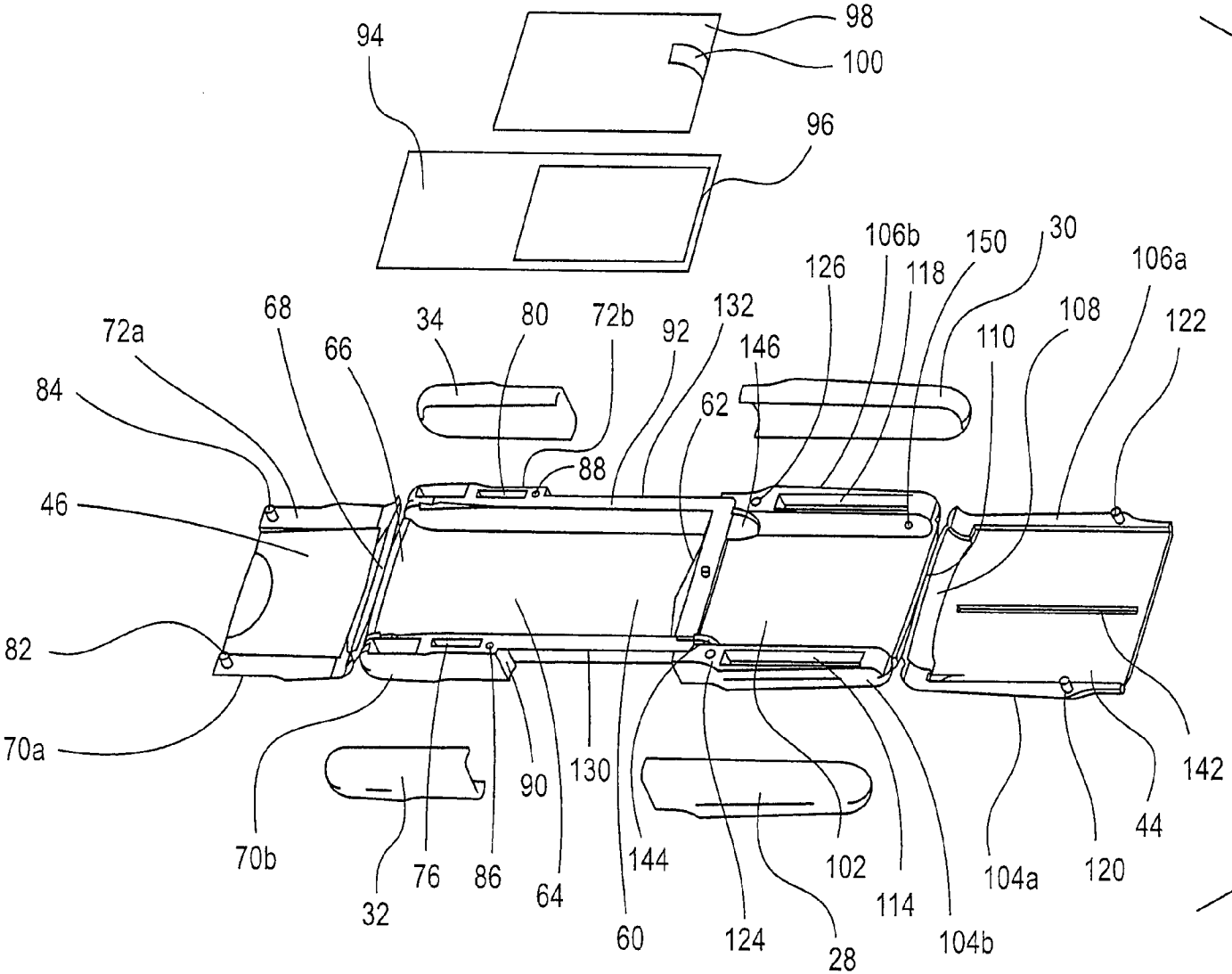
FIG. 3 is an exploded view of the sections of the container.

Further details of the container 20 will be apparent to those skilled in the art from the exploded view of FIG. 3. For example, the second section 24 is preferably fabricated as an open clam shell piece and may be molded from a suitable conventional plastic material. The open clam shell includes the top panel 46, a bottom panel 64, and an end panel 66 having an integral hinge 68 therein. In addition the open claim shell has a pair of sides 70*a*, 70*b*, and 72*a*, 72*b* which extend between the top panel 46 and the bottom panel 64. The sides or side walls may contain one or more open cores, 74, 76, 78, 80 to make the side walls more flexible, to reduce weight of the container, and to save material.

To establish proper alignment when the clam shell is closed, the side walls may include alignment devices. For example, the side wall portions 70*a*, 72*a* attached to the top panel 44 may each include a corresponding alignment pin 82, 84 projecting substantially perpendicularly to the hinge 68. Those alignment pins 82, 84 are received by and may snap into corresponding openings 86, 88 in the side wall portions 70*b*, 72*b* attached to the bottom panel 64. With a snap fit or an interference fit, the alignment devices are operable to hold the claim shell of the second section 24 in a closed position.

The bottom panel 64 projects beyond an openable end 90 of the second section 24 where the openable end 90 essentially defines the parting line 26. The bottom panel 64, the lower side walls 70*b*, 72*b*, the end wall 66, and the sloped end wall 62 define the generally rectangular tray 60. Thus, the tray 60 may be integral with the second section 24 and includes a portion which projects beyond the openable wall 90. It is also within the contemplation of this disclosure that a separate tray be used in connection with the container 20. The separate tray may be separately molded to allow filing the product and sealing in the tray as described herein. Such a separate tray would be locked in the first section described above, e.g., it could be held in place by a detent or latching assembly so that it does not become inadvertently dislodged from the first section during use.

A sealing surface 92 circumscribes the peripheral edge of the tray 60. The sealing surface 92 is adapted to receive a first seal 94 fashioned from a suitable conventional material. The first seal 94 may include a window 96 adjacent one end. The window 96 is sized to expose the portion of the tray 60 which extends beyond the openable end 90. To cover the window 96, a second seal 98 is provided which may include a pull tab 100. The second seal is preferably sealingly secured to the first seal 94, which in turn is sealingly secured to the sealing surface 92. By pulling on the tab 100 and removing the second seal 98, the window 96 of the first seal 94 is opened and the contents of the tray 60 are exposed for dispensing or removal and subsequent use.

Figure 6:
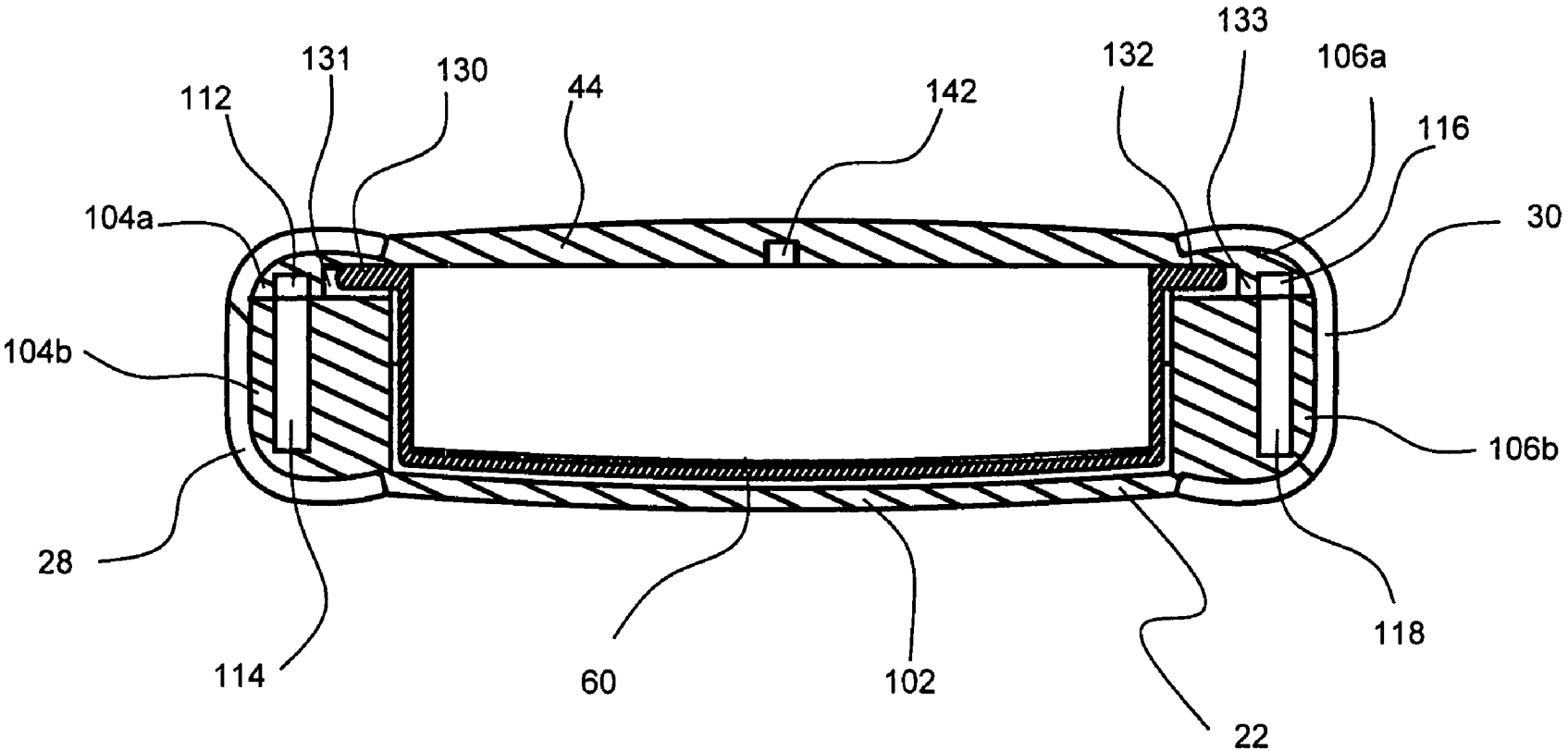
FIG. 6 is an enlarged transverse cross-sectional view taken along the line 6-6 of FIG. 4.

The first section 22 may also be fabricated as an open clam shell and may also be molded from a suitable conventional plastic material. Like the second section 24, the first section 22 includes the top panel 44 and a bottom panel or wall 102, both of which are attached to an end wall 108 having an integral hinge 110. A second pair of side walls 104*a*, 104*b*, 106*a*, 106*b* (see FIG. 6) extends between the top panel 44 and the bottom panel 102. As with the second section 24, each side wall of the first section 22 may include a corresponding open core 112, 114, 116, 118 to increase flexibility, to reduce weight, and to save molding material. Also, to establish proper alignment when the clam shell of the second section 24 is closed, the side walls may include alignment devices. For example (see FIG. 3), the side wall portions 104*a*, 106*a* attached to the top panel 44 may each include a corresponding alignment pin 120, 122 projecting substantially perpendicularly to the hinge 110. Those alignment pins 120, 122 are received by and may snap into corresponding openings 124, 126 in the side wall portions 104*b*, 106*b* attached to the bottom panel 102. With a snap fit or an interference fit, the alignment devices are operable to hold the claim shell of the first section in a closed position.

Figure 7:
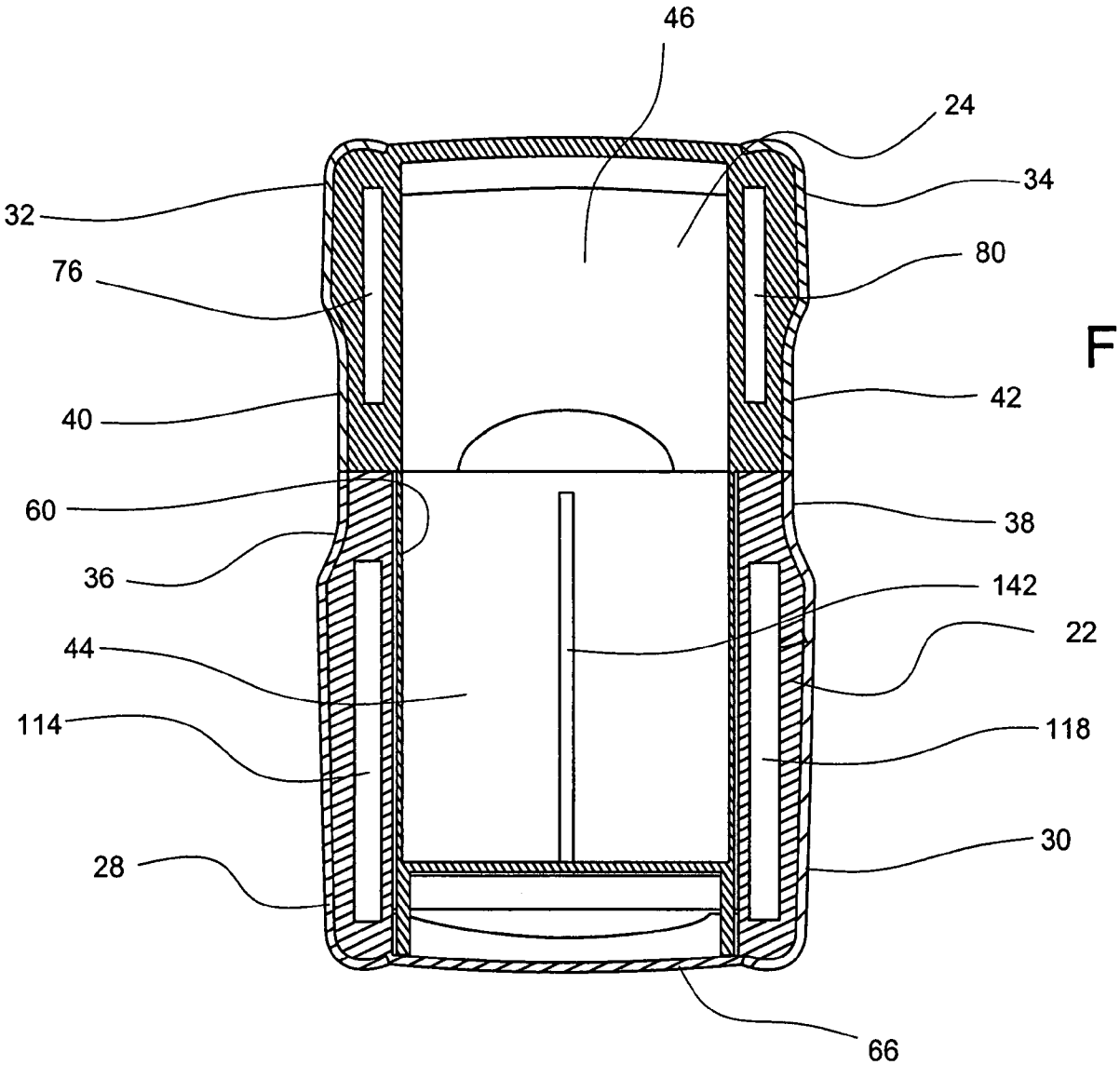
FIG. 7 is a cross-sectional view taken along the line 7-7 of FIG. 5.
Figure 8:
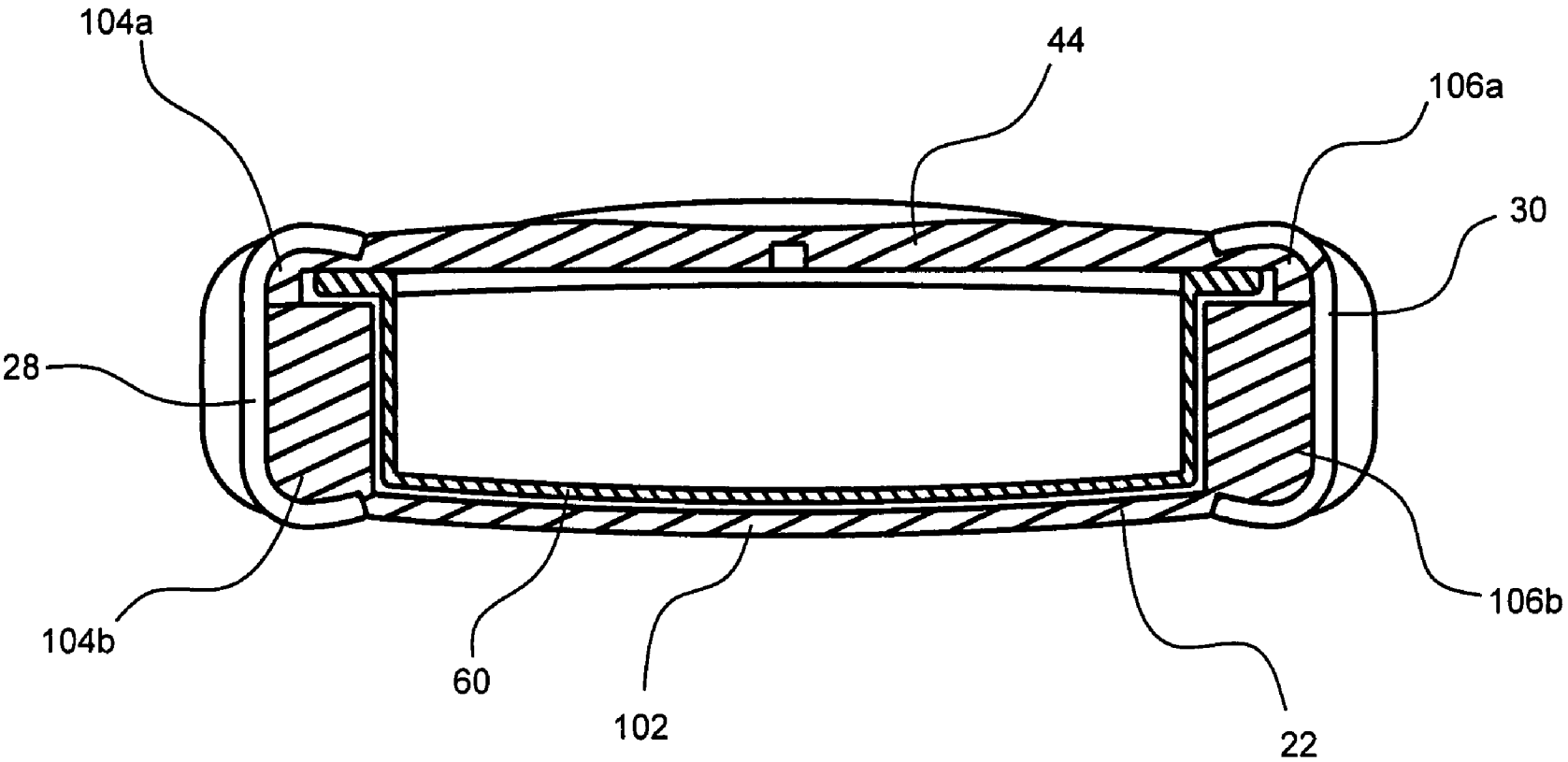
FIG. 8 is an enlarged cross-sectional view taken along the line 8-8 of FIG. 5.

To further secure the clam shells of the first section 22 and the second section 24 in their closed positions, the corresponding pairs of edge covers or cheek members 30, 32, 34, 36 are used. Each cheek member has a C-shaped cross section (see FIG. 8) and is shaped to conform to the associated two-part side wall. By clipping the cheek member to its associated side wall, the cheek member covers the separation surfaces between the upper and lower portions of the corresponding side wall and conceals the associated edges. Moreover, the resilient character of the cheek members coupled with their three-dimensional configuration longitudinally fixes the cheek members relative to the associated section. More particularly (see FIG. 7), one end of the cheek member 28 it rounded and engages a portion of the end wall 66 of the first section 22 while the other end of the cheek member 28 includes the depression 36 adjacent to the parting line 26. Those end features of the cheek member 28 fix is longitudinally relative to the first section, while the C-shaped cross section holds the cheek member 28 laterally with respect to the first section 22. Similar features of the other cheek members 30, 32, 34 result in the same fixed spatial positioning relative to the associated first and section sections 22, 24.

To provide a smooth sliding operation between the first and second sections 22, 24, at least one pair of projections or guide rails 130, 132 may be provided. The guide rails 130, 132 preferably extend longitudinally along the side walls of the tray 60 and extend from the openable wall 90 for a distance exceeding the distance between fully closed and fully opened positions of the first and second sections 22, 24. In that way, the guide rails 130, 132 remain engaged with corresponding channels or guide slots in the other section. Preferably the guide rails 130, 132 are located at the top edge of the tray 60 so that they also serve as part of the sealing surface 92. However, it is possible to provide the guide rails at any other desired position on the sides or bottom of the tray 60. Nevertheless, some locations, such as the preferred position, offer convenience in fabrication of the corresponding channels. For example, with the preferred guide rail position, the associated channels may be formed at the inner edges of the side walls 104*b*, 106*b* of the first section 22.

Figure 5:
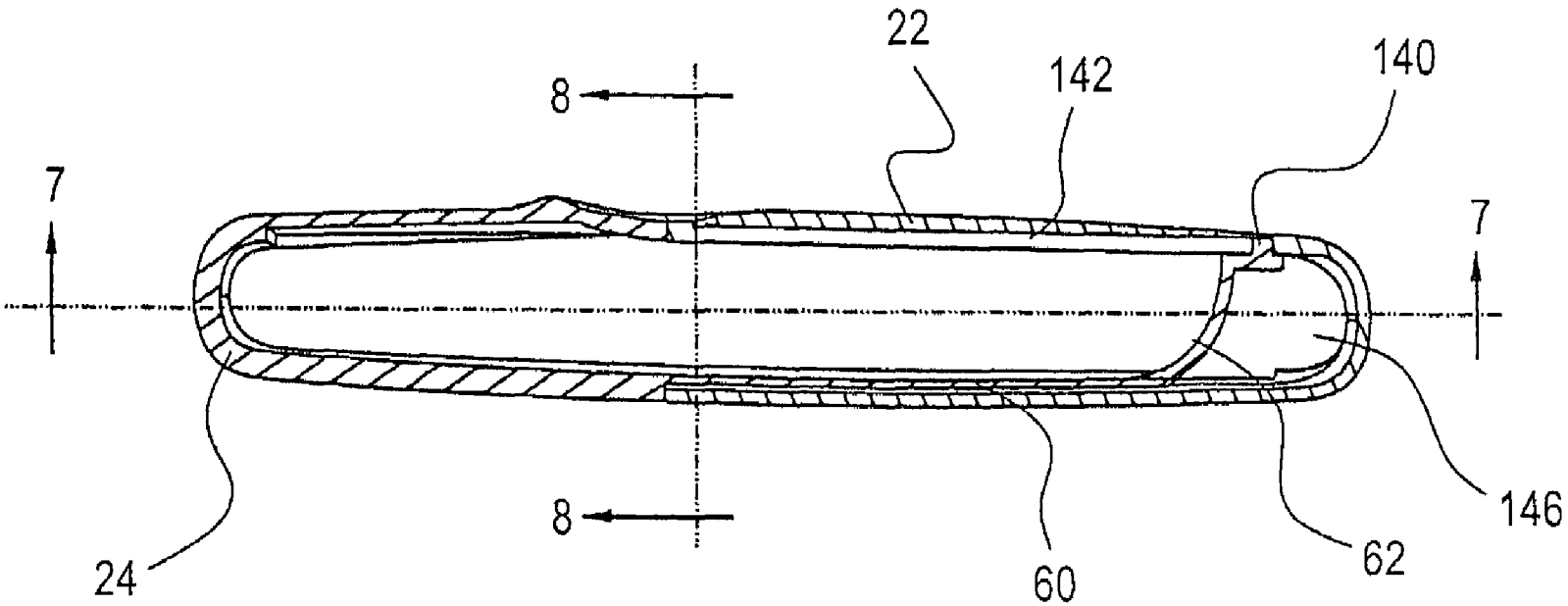
FIG. 5 is a longitudinal cross-sectional view taken along the line 5-5 of FIG. 4.

Smooth sliding operation between the first and second sections 22, 24 is further facilitated by providing a projection or guide pin 140 at the distal end of the tray 60 and a cooperating slot on the inside of the top panel 44 of the first section 22 (see FIG. 5). The guide pin 140 and the associated guide slot 142 cooperate to keep the first and section sections 22, 24 in longitudinal alignment during sliding movement therebetween. Moreover, the slot 142 determines the maximum distance that the second section 24 can slide away from the first section 22 by abutment of the pin 140 with an end of the slot 142. While the pin and associated slot arrangement is shown in the drawings as being at the top of the tray, that location is not critical. For example, the arrangement could be positioned at the bottom of the tray. Furthermore, the pin can be located on one of the first and second sections 22, 24, while the slot can be located on the other one of the first and second sections 22, 24.

It is also desirable that the first and second sections 22, 24 be detained in the closed position so that the contents of the tray 60 do not inadvertently spill or fall out. To this end, a suitable detention arrangement is provided between the first and second sections 22, 24. For example, the projecting portion of the tray 60 (see FIG. 3) may include a pair of ears 144, 146, one on each side. Each ear 144, 146 may also include a laterally extending pin or projection (not shown). The inner wall of each side wall 104*b*, 106*b* has a recess or opening 150 shaped to conform to and receive the corresponding projection. The ears 144, 146 may be sized to abut the end wall 108 of the second section 24 or may be sized to be spaced from the end wall 108. Nevertheless, the projections and cooperating opening 150 are positioned so that the projection engages the associated opening 150 when the two sections 22, 24 are in the closed position. In this way, the sections 22, 24 are releasably detained in the closed position. Plainly, the locations of the projections and the openings could be reversed, if desired, so that the projections are on the side walls and the cooperating openings are located on the ears.

The particular proportions of the container according to this disclosure are not critical. The proportions are preferably selected to provide a tray suitably sized to accommodate the particular articles to be packaged therein. Thus, the actual container could be more elongated than the container shown in the drawings. Or, the actual container could be more nearly square, i.e., shorter than shown in the drawings. Preferably, however, the container is sized so that it can be conveniently carried in a pocket.

Figure 9:
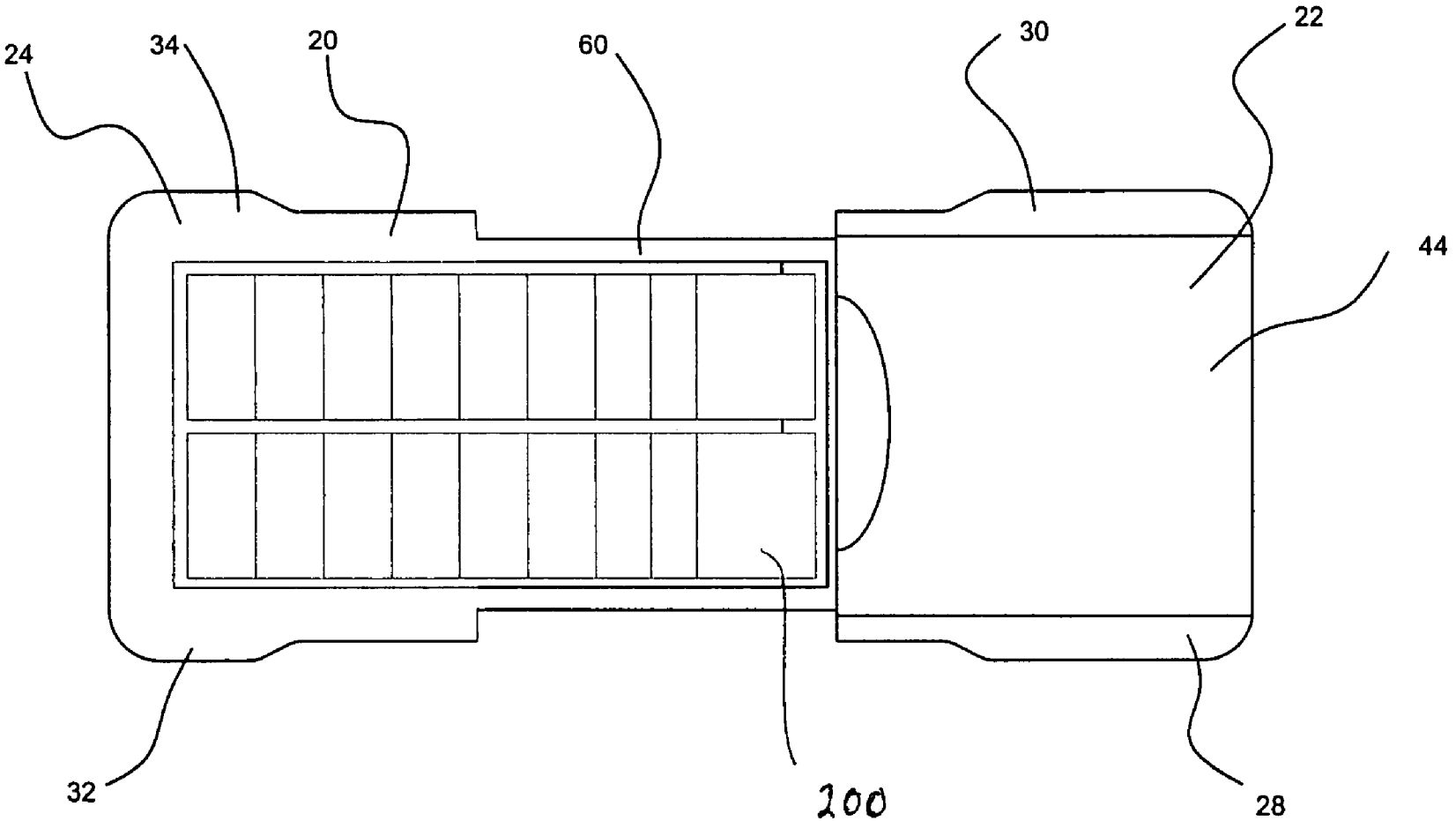
FIGS. 9-12 show various product arrangements in a container with portions removed for purposes of clarity.
Figure 10:
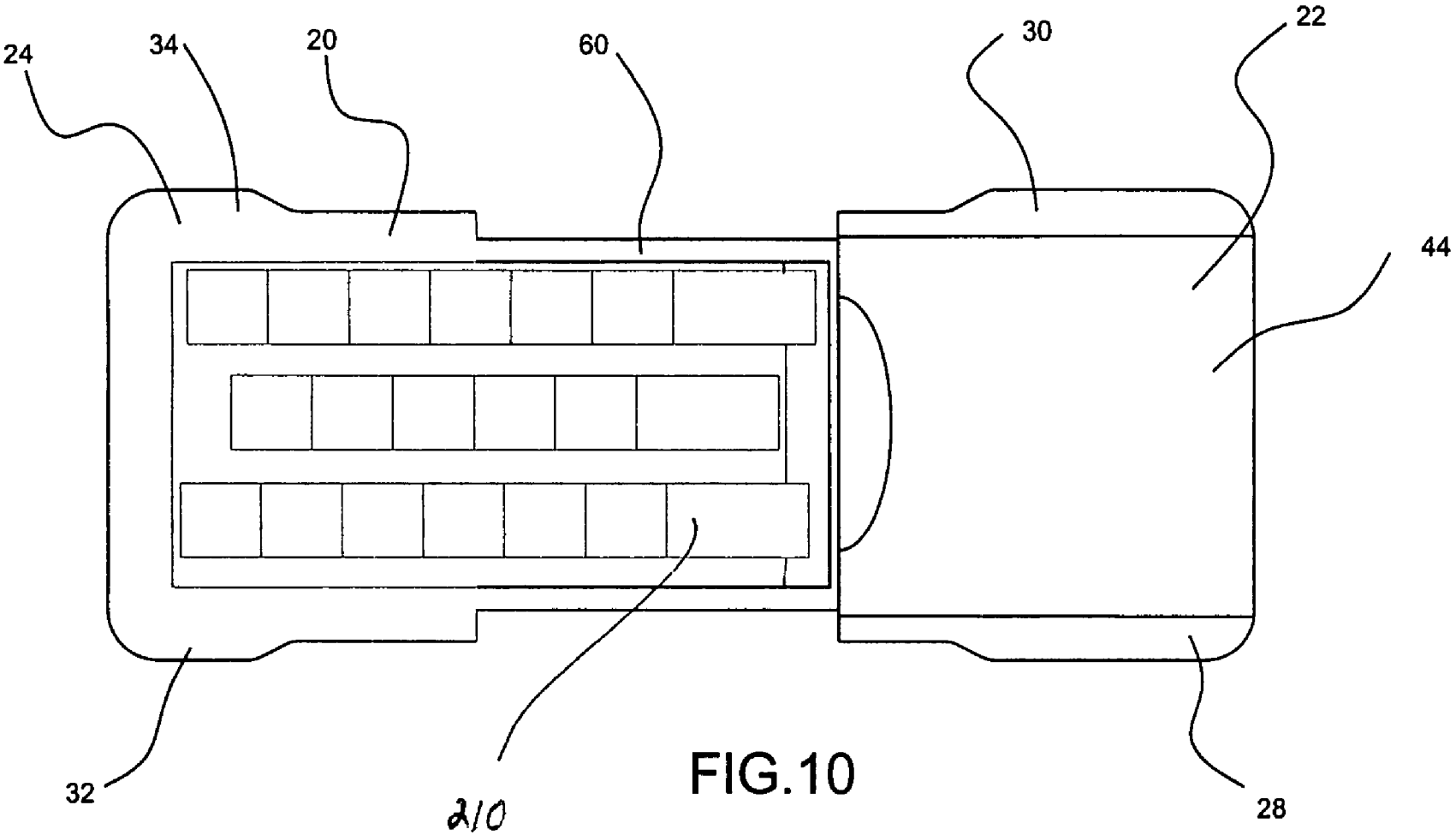
Figure 11:
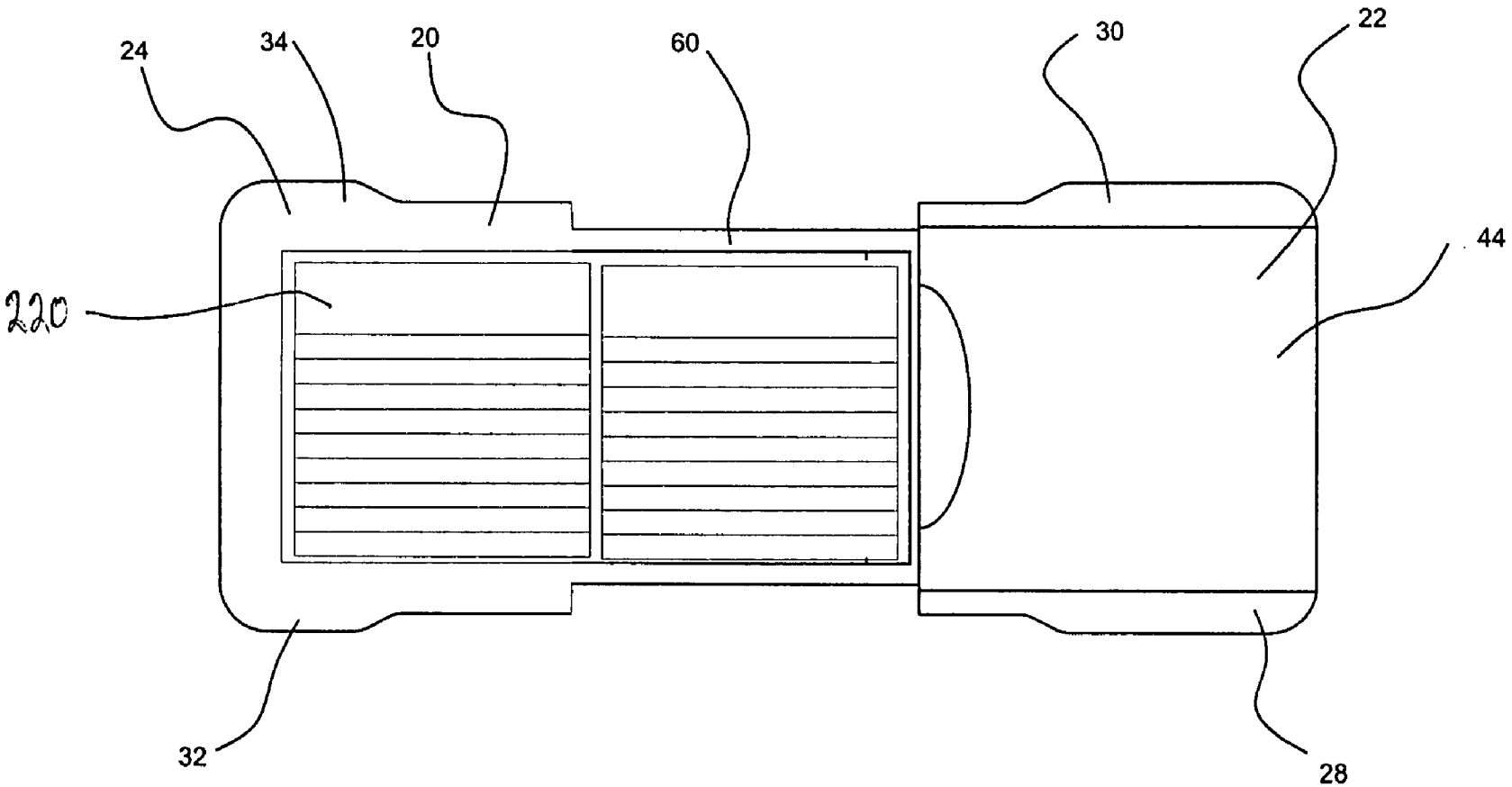
Figure 12:
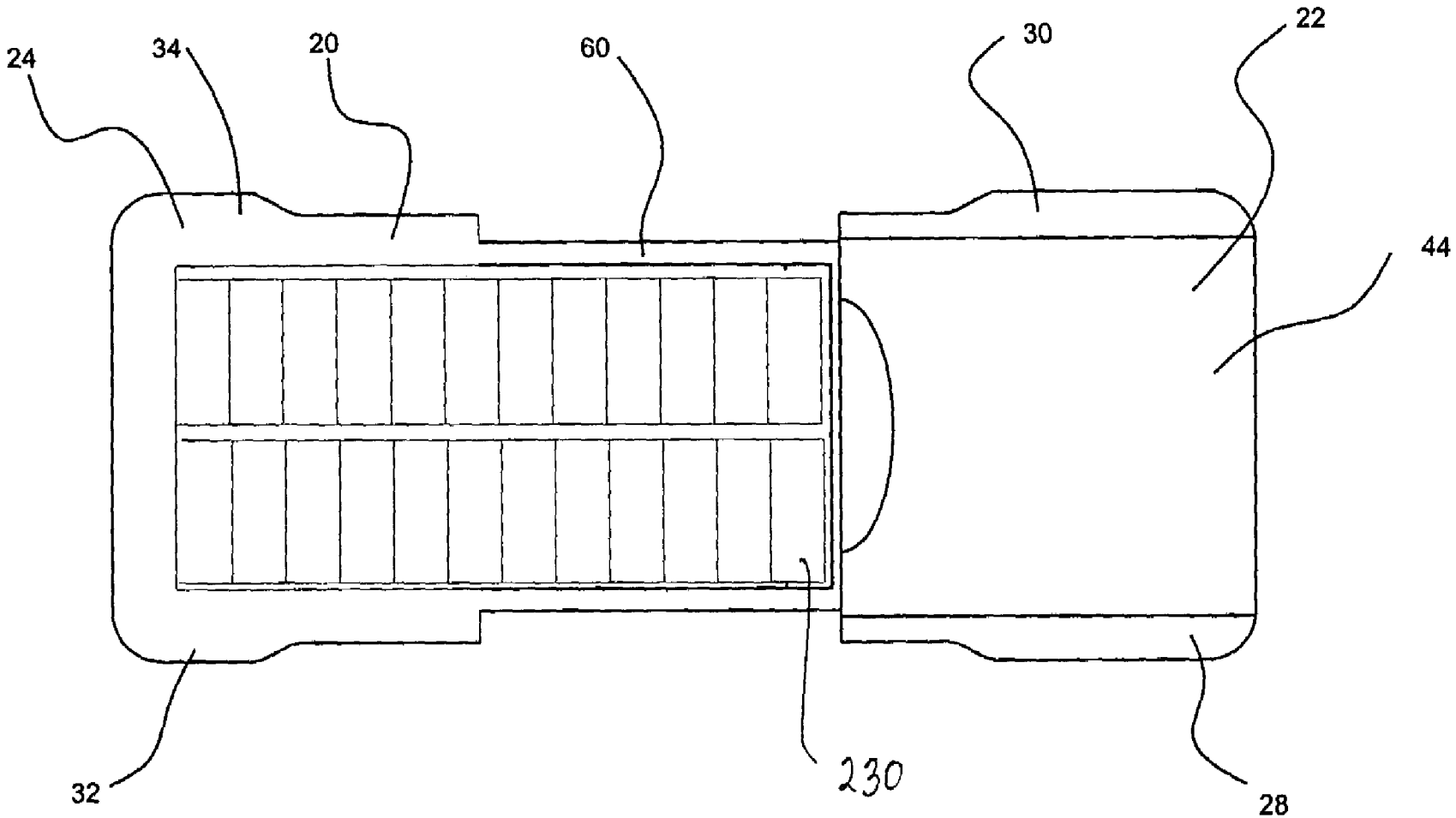

Furthermore, the products can be arranged in various ways in the tray 60. For example, the products 200 can be arranged in two parallel rows, with the products overlapping in the tray 60 (see FIG. 9). Or, the products 210 can be arranged in three parallel rows, stggered relative to one another, and arranged longitudinally in the tray 60 (see FIG. 10). Depending upon the size of the products 220, the products can be arranged in two parallel rows, the products overlapping one another, and the rows extending transversely across the tray 60 (see FIG. 11). In yet another arrangement, individual products 230 can be packed against one another in two or more parallel rows extending longitudinally in the tray 60 (see FIG. 12). Of course, if the products are small enough, they can be randomly placed in the tray 60.

The container of this disclosure can, of course, be used for a variety of products. One specific product for which the container can be used is commercially available smokeless pouched tobacco. Such tobacco packets are sometimes known as "snus" and comprise an individual packet off tobacco material encased in a pouch material.

It will now be apparent to those skilled in the art that a new container has been disclosed which has new, useful, and nonobvious features and characteristics. It will further be apparent to those skilled in the art that numerous modifications, variations, substitutions, and equivalents exist for features of the new container that do not materially depart from the spirit and scope of this invention. Accordingly, it is expressly intended that all such modifications, variations, substitutions, and equivalents for features of the appended claims, be embraced thereby.

What is claimed is:

1. A container comprising:

a first clam shell element having an integral tray, a top panel attached to one end of the tray by an integral hinge, the top panel being movable to a position overlying a first portion of the tray such that a second portion of the tray is uncovered;

a second clam shell element having an top panel, a bottom panel and an integral hinge between the top panel and the bottom panel, the second clam shell element constructed and arranged to receive the second portion of the tray, the top panel being movable to a position overlying the second portion of the tray to form a tray receiving cover;

a guiding arrangement between the first clam shell element and the second clam shell element to allow sliding movement between a first position where the first clam shell element abuts the second clam shell element and a second position where the second portion of the tray is exposed; and a cheek member on a side of at least one of the first and second clam shell elements, the cheek member attached with a snap fit, wherein the tray has a first sealing member covering the tray and attached thereto.

2. The container of claim 1, wherein the guiding arrangement includes a pair of guide rails on one of the first and second clam shell elements and cooperating guide slots on the other of the first and second clam shell elements.

3. The container of claim 2, where the guide rails extend longitudinally along the second portion of the tray and wherein the cooperating guide slots are located within the second clam shell element.

4. The container of claim 2, wherein the guiding arrangement includes a projection extending laterally from one of the first and second clam shell elements, and a longitudinal groove in the other of the first and second clam shell elements, where the projection is received in and guided by the longitudinal groove.

5. The container of claim 1, wherein the guiding arrangement includes a projection extending laterally from one of the first and second clam shell elements, and a longitudinal groove in the other of the first and second clam shell elements, where the projection is received in and guided by the longitudinal groove.

6. The container of claim 1, wherein both the first and second clam shell elements include cheek members.

7. The container of claim 1, wherein the first sealing member includes a window over the second portion of the tray.

8. The container of claim 7, further including a second sealing member sealingly covering the window.

9. The container of claim 8, wherein the second sealing member includes a pull tab to remove at least that portion of the second sealing member which covers the window.

10. The container of claim 1, wherein the tray contains a plurality of consumer products.

11. The container of claim 10, wherein the consumer products are arranged in at least one row extending longitudinally along the tray.

12. The container of claim 10, wherein the consumer products are arranged in at least one row extending transversely across the tray.

13. The container of claim 10, wherein the consumer products are arranged in a plurality of staggered rows extending longitudinally along the tray.

14. The container of claim 10, wherein the consumer products are arranged randomly in the tray.

15. The container of claim 10, wherein the consumer products are smokeless tobacco pouches.

* * * * *